United States Patent [19]

Suzuki

[11] Patent Number: 4,674,383

[45] Date of Patent: Jun. 23, 1987

[54] ELECTRONIC MUSICAL INSTRUMENT PERFORMING AUTOMATIC ACCOMPANIMENT ON PROGRAMMABLE MEMORIZED PATTERN

[75] Inventor: Satoshi Suzuki, Hamamatsu, Japan

[73] Assignee: Nippon Gakki Seizo Kabushiki Kaisha, Hamamatsu, Japan

[21] Appl. No.: 876,978

[22] Filed: Jun. 20, 1986

[30] Foreign Application Priority Data

Jun. 21, 1985 [JP] Japan ..... 60-134234
Jun. 21, 1985 [JP] Japan ..... 60-134235

[51] Int. Cl.[4] ..... G10H 1/38; G10H 1/42; G10H 7/00

[52] U.S. Cl. ..... 84/1.03; 84/DIG. 12; 84/DIG. 22

[58] Field of Search ..... 84/1.03, DIG. 12, DIG. 22

[56] References Cited

U.S. PATENT DOCUMENTS 4,339,978 7/1982 Imamura ..... 84/1.03
4,344,345 8/1982 Sano ..... 84/1.03
4,520,707 6/1985 Weil, Jr. et al. ..... 84/1.03
4,539,882 9/1985 Yuzawa ..... 84/1.03
4,619,176 10/1986 Isii ..... 84/1.03

*Primary Examiner*—S. J. Witkowski
*Attorney, Agent, or Firm*—Spensley Horn Jubas & Lubitz

[57] ABSTRACT

An electronic musical instrument has an accompaniment keyboard arranged to detect, in programming mode, accompaniment key informations including the actuated timings of the depressed keys relative to a tempo from a tempo generator as well as the relative tone pitches of the depressed keys, and to store these informations in a writable memory as a custom-made accompaniment timing and pitch pattern data. In a performance mode, the keys are used to designate chord names each by its tonality and type for determining the chords to be automatically performed in accordance with the custom-made accompaniment timing and pitch pattern. By reading-out these stored information data, the user is able to perform automatic accompaniment playing of his own programmed pattern with real time.

5 Claims, 21 Drawing Figures

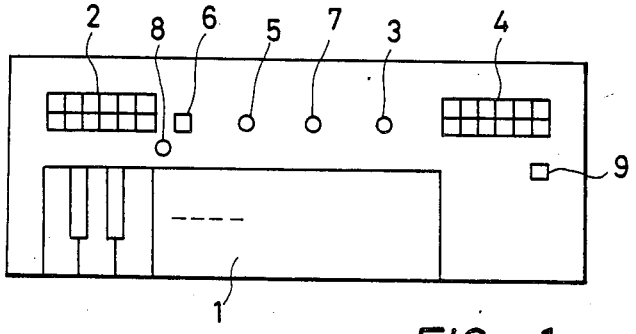
FIG. 1
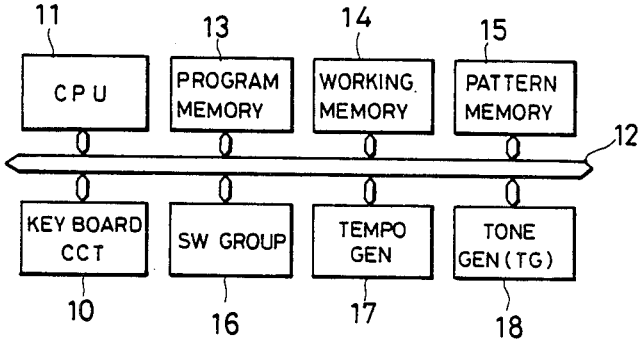
FIG. 2
| KEYS | $C_1$ $C_1^{\#}$ ... $B_1$ | $C_2$ ... | $C_3$ ... | $C_4$ ... | $C_5$ ... | $C_6$ ... | $C_7$ | REST |
|---|---|---|---|---|---|---|---|---|
| KEY CODES | 12 13 | 23 24 | 36 | 48 | 60 | 72 | 84 | 0 |
FIG. 3

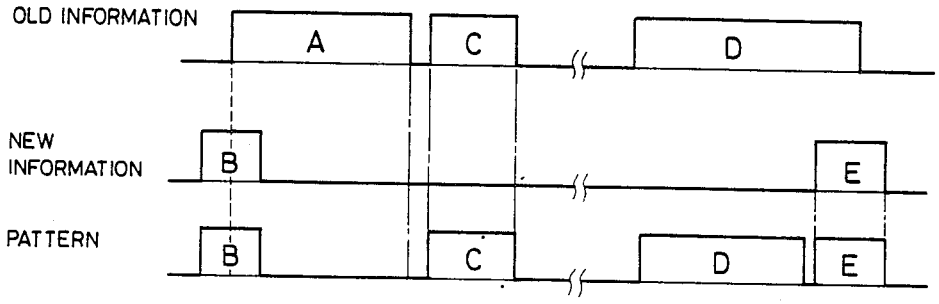
FIG. 13
| NOTE / CHORD | 4 (E) | 7 (G) | 11 (B) | OTHERS |
|---|---|---|---|---|
| C | 0 | 0 | 0 | 0 |
| CM7 | 0 | 0 | 0 | 0 |
| Cm | -1 | 0 | 0 | 0 |
| C7 | 0 | 0 | -1 | 0 |
| C7SUS4 | +1 | 0 | -1 | 0 |
| Cm7 | -1 | 0 | -1 | 0 |
| Cm7$^{-5}$ | -1 | -1 | -1 | 0 |
FIG. 14
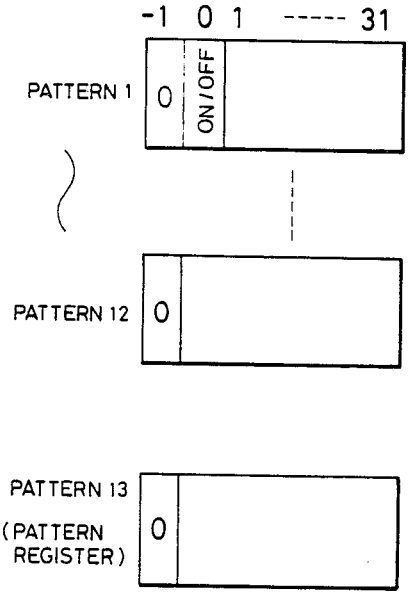
FIG. 15

| COHRD \ ch | 1 | 2 | 3 | 4 |
|---|---|---|---|---|
| C | 0 | 4 | 7 | 12 |
| $C_{M7}$ | 0 | 4 | 7 | 11 |
| Cm | 0 | 3 | 7 | 12 |
| $C_7$ | 0 | 4 | 7 | 10 |
| $C_{7SUS4}$ | 0 | 5 | 7 | 10 |
| $C_{m7}$ | 0 | 3 | 7 | 10 |
| $C_{m7}^{-5}$ | 0 | 3 | 6 | 10 |

FIG. 21

ELECTRONIC MUSICAL INSTRUMENT PERFORMING AUTOMATIC ACCOMPANIMENT ON PROGRAMMABLE MEMORIZED PATTERN

BACKGROUND OF THE INVENTION (a) Field of the invention:

The present invention relates to an electronic musical instrument having an automatic accompaniment device which, in one aspect, is capable of automatically performing an accompaniment of a pattern custom-made or programmed by the user, and in another aspect, capable of automatically producing a so-called rhythmic chord accompaniment by beating those chord tones inputted by the user's manipulation of the keyboard with a desired rhythm.

(b) Description of the prior art:

In the past, there has been known an automatic accompaniment device for use in an electronic musical instrument arranged so that an accompaniment pattern such as arpeggio or arpeggic chord (which is an arpeggio of a plurality of simultaneously produced tones) of a normalized pitch format which is stored in a ROM (Read-Only Memory) is subjected to, for example, a tonality shifting in accordance with the chord information inputted by the user's manipulation of keys on the keyboard to thereby alter the tone pitches into absolute tone pitches for being sounded out as an automatic accompaniment. Such an automatic accompaniment as effected in the prior art, however, is nothing but a mere automatic reproduction of factory-made accompaniment patterns which have been stored in advance in a memory means of the device, and accordingly it has not necessarily given satisfaction to the user.

Also, as a rhythmic chord accompaniment device of the prior art for use in an electronic musical instrument, there is the one which performs a conventional auto-bass-chord (ABC), and the one which performs an automatic accompaniment by using a chord sequencer based on stepwisely inputted chords. It should be noted, however, that the rhythmic chord accompaniment device which plays auto- bass-chords has the inconvenience that the accompaniment performance is scarce in variation and lacks the tint of one's tastes or liking because, as stated above, such an accompaniment is only the reproduction of the preliminarily memorized pattern. The chord sequencer, on the other hand, is a device designed to input informations of tone pitches and note durations stepwisely. Thus, this latter device is of such disadvantages that the player (user) is unable to quickly catch or grasp the actual performance, and this in turn gives the player a difficulty in making a subtle controlling of timing for key depressions and key releases.

SUMMARY OF THE INVENTION

It is, therefore, a primary object of the present invention to provide an electronic musical instrument having an automatic accompaniment function allowing its player to program his or her own original accompaniment patterns in a simplified manner for the automatic performance thereof. More particularly, in such a musical instrument as mentioned above, the information concerning an accompaniment key depression timing occurring on the keyboard of the instrument is automatically detected. By storing, in a writable memory, the information of this detected key depression timings and also the information of the relative pitches of the depressed keys, the user is able to form a desired accompaniment pattern with a real time of the operation of the keys of the keyboard.

Another object of the present invention is to provide an electronic musical instrument having a rhythmic chord accompaniment function, which is arranged to automatically detect the depression timing or timings of keys intended to designate the chord tone producing timing or timings, and to store the detected timing or timings in a rewritable memory to thereby allow the user to form a desired rhythm chord pattern with a real time which is equal to the speed of the actual key depression or depressions. More particularly, in an electronic musical instrument having a rhythmic chord accompaniment device for performing a chord accompaniment by automatically beating at a predetermined rhythm or timing, it should be noted that the programming of a rhythmic chord accompaniment pattern is entrusted with the player himself of the instrument so as to enable the player to form an accompaniment pattern suitable for the player's own performance with real time inputting.

According to the present invention, the electronic musical instrument having an automatic accompaniment function comprises: detecting means for detecting the timing of generation of a key information caused by the user's keyboard operation based on a predetermined reference performance tempo; rewritable memory means for storing the detected key information concerning relative note pitches of the depressed keys and also the information of the generating timing of such key information; and selecting means capable of selecting these informations read out from the memory means as the accompaniment pattern informations to be used at the time of an automatic performance. That is, the electronic musical instrument of the present invention is arranged so that when the player performs a desired accompaniment with a predetermined tempo, such an accompaniment performance is automatically stored in the memory as an accompaniment pattern.

These and other objects as well as features and advantages of the present invention will be apparent from the following detailed description of the preferred embodiments when taken in conjunction with the accompaniment drawings.

BRIEF DESCRIPTION OF THE DRAWINGS

FIG. 1 is a general plan view of the layout on the surface of the panel board of the electronic musical instrument according to an embodiment of the present invention.

FIG. 2 is a block diagram showing the hardware structure of the instrument of FIG. 1.

FIG. 3 is a correspondency between keys and key codes for use in the instrument of FIG. 1.

FIG. 13 is an explanatory illustration of the overwriting example done in the instrument of FIG. 1.

FIG. 14 is a format of the key code conversion table used in the memory.

FIG. 15 is another format of pattern memory for use in the instrument of FIG. 1.

FIG. 21 is a key-off setting data table contained in the format of pattern data memory shown in FIG. 15.

Throughout the drawings, like parts are indicated by like reference numerals and symbols for the sake of simplicity.

DETAILED DESCRIPTION OF THE PREFERRED EMBODIMENTS

Figure 4:
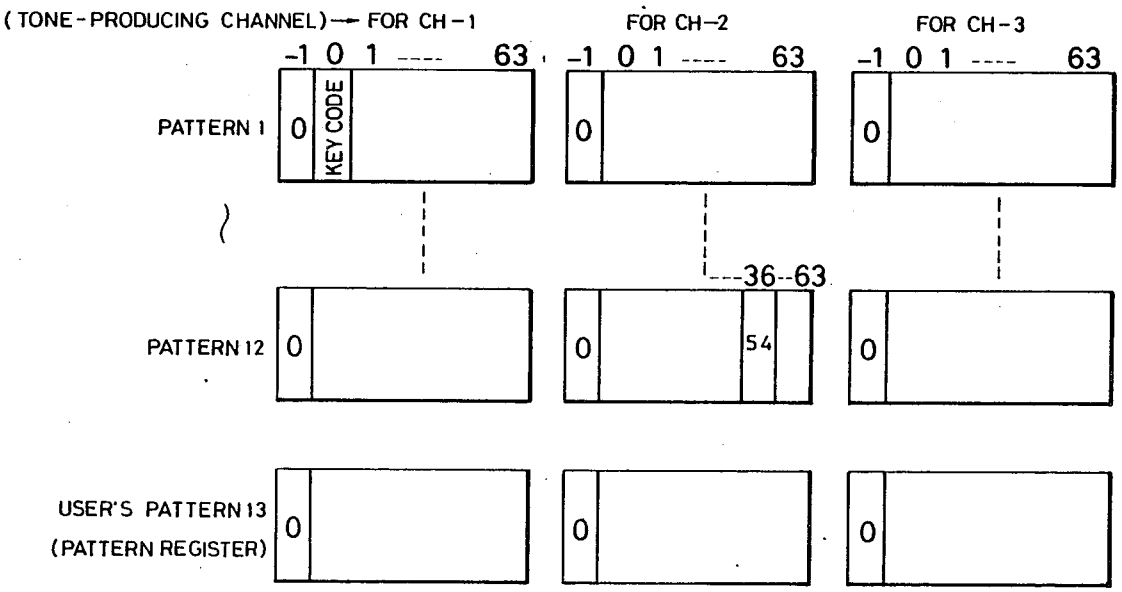
FIG. 4 is a pattern memory format for use in the instrument of FIG. 1.

Description will hereunder be made of a first embodiment of the present invention by referring to the accompanying drawings.

FIG. 1 shows the general view of the operating panel surface of the electronic musical instrument having a custom accompaniment function according to the first embodiment of the present invention. This electronic musical instrument should be understood to represent such a type that the present invention is applied to an electronic musical instrument designed to make an automatic performance while modifying the accompaniment pattern which is read out successively from the pattern memory in accordance with the chord information inputted successively from the keyboard.

ARRANGEMENT OF THE ELECTRONIC MUSICAL INSTRUMENT OF FIG. 1

On the operating panel surface of FIG. 1 are arranged a keyboard 1 for melody playing; pattern selecting switches 2 for selecting any one of the factory-made accompaniment patterns preliminarily stored in the above-mentioned pattern memory; a group of switches such as run/stop switch 3 for selecting carry-out/cease of an automatic accompaniment and tone color selecting switches 4, all of which are similar to those employed in conventional electronic musical instruments; and in addition to the above, a program switch 5 for selecting a program mode (accompaniment pattern programming mode); a user's-pattern switch 6 for selecting, at the time of an automatic accompaniment playing, a user's-pattern which has been composed as an accompaniment pattern in accordance with the programming mode; a clearing switch 7 for totally erasing the user's-patterns under the programming mode; a transferring switch 8 for preliminarily copying a desired accompaniment pattern as the user's-pattern when either one of the factory-made accompaniment patterns is corrected to compose the user's own accompaniment pattern; and a metronome indicating lamp 9 which is lighted up for each one beat (4th note) to inform the instrument player of the performance tempo.

FIG. 2 shows a hardware structure of the electronic musical instrument of FIG. 1. In FIG. 2, a keyboard circuit 10 detects depressed key or keys of the keyboard 1 (FIG. 1) and generates key information (key code) indicative of the depressed key or keys. As shown in FIG. 3, this key code is formed by allotting multiples of "12" (decimal notation), i.e. 12;, 24, 36, . . . for respective C notes corresponding to the positions $C_1$, $C\#_1$, $D_1$, . . . , $B_1$, $C_2$, . . . , respectively, of the depressed keys and by allotting, to other keys, numerical values which increment by one (1) for each half-tone step-up. Also, the key code for the rest, i,e. indicating the state that none of the keys is being depressed, is expressed by "0". It should be noted here that, in the following description, those numerical data such as key codes will be indicated by decimals unless otherwise indicated.

To a central processing unit (CPU) 11 are electrically connected, via a bidirectional bus-line 12, said keyboard circuit 10, a program memory 13, a working memory 14, a pattern memory 15, a switch group 16 comprised of respective operating switches 2 to 8 (FIG. 1), a tempo generator 17, a tone generator (TG) 18, and so forth.

The CPU 11 controls the operations of the instant electronic musical instrument as a whole, including the writing of the key informations outputted from the keyboard circuit 10 as well as of the switching informations delivered from the switch group 16; the formation of predetermined tone informations (informations concerning commencement of tone production, cease of tone production, and informations concerning tone pitches, tone colors, etc.) by mathematical processing based on the key informations and switch informations mentioned above, and the delivery of these tone informations to the tone generator 18.

The program memory 13 is comprised of a ROM (Read-Only Memory), and stores the control program to be used by the CPU 11.

The working memory 14 is intended to temporarily store various data which are generated when the CPU 11 carries out a control program. This working memory 14 is comprised of, for example, a RAM (Random Access Memory), and is provided with the below-mentioned various flags, registers, buffers and the like.

QNT: Clock counter

Counts tempo clocks "0"~"2" (ternary counts 0, 1, 2).

CLK: Timing counter

Its count value increments stepwise by "1" when the count value of QNT returns to "0" from "2". This counter takes count values from "0" up to "63" (wherein, count values "0"~"31" indicate respective current timings occurring in odd-number measures, and count values "32"~"63" indicate current timings for even-number measures.

OLDCLK: Old timing value register

Normal: CLK "−1"

However, when CLK="0", then OLDCLK="63"

RUN: Run flag

This flag indicates whether an arpeggic chord is running (="1") or has ceased (="0").

$TIME_1$~$TIME_3$: Timers

There are provided three timers for three pitch-processing channels, respectively. They count clocks after the generation of the old event up to the present time. However, count value for "no event" is designated as "255", and at the time of a "key-on", it assumes "0", whereas for a "key-off", a value of "+128" is added. Also, for a running "key-on" due to actual key depression, count value for such a case is designated as "0". Whereby, it should be noted that, at the time of assigning a channel, it is possible to seek a maximum value among the TIME values to arrange priority of assignment in such an order: empty channel>oldest key-release channel>oldest key-depression channel.

$KC_1$~$KC_3$: Key code registers for programming

In the programming mode, a key code is stored in $KC_i$ during the run of "key-on" of the specific channel "i" which is occupied due to actual depression of a key, while other two KCs remain to be "0". These registers are used for scanning the "key-off" channels at the time of key release.

T: Provisional buffer for CLK

ROOT: Root note name register

It assumes values "0"~"11" correspondingly to note names C, C#, . . . , B, respectively.

CHORD: Chord type register

It assumes values "0"~"7" correspondingly to chord types C, $C_{M7}$, $C_m$, $C_7$, $C_{7sus4}$, $C_{m7}$, and $C_{m7}{-}^5$, respectively.

DLT, NOTE: Provisional buffers

KEY: Key code register for arpeggic chords $(m)_i$: Pointer for reading-out data This is intended to read out data contained in the pattern memory 15. m=T, OLDT, CLK, OLDCLK. This pointer $(m)_i$ points to the contents of the address "m" of the tone-producing channel "i" in the specific pattern number designated by the pattern selecting switch (including the user's-pattern switch).

It should be noted here that, in the following description, the respective registers and their contents will be both indicated by the same label names. For example, the key code register for arpeggic chords and its contents will both be expressed by "KEY". Said key code register is one which is provided to serve in case three tone pitches are used.

As shown in FIG. 4, the pattern memory 15 is comprised of a ROM area intended exclusively for reading-out those factory-made accompaniment patterns (pattern Nos. 1~12) stored therein and a rewritable RAM area (pattern register) storing user's-pattern (pattern No. 13). The respective pattern areas are provided with key code storing areas of a 65-byte length for three channels (ch 1~ch 3), respectively, for storing accompaniment data (key codes "12"~"84" and rest notation datum "0"). These patterns are such that their addresses ("0"~"63") correspond to the count values of the timing counter CLK. That is, the datum at each address indicates that the tone of that key code is sounding to either a key depression or a key release at that address (namely, timing) thereby representing the sequence of tone production for an accompaniment performance.

The tempo setter (generator) 17 is comprised of, for example, a frequency-variable oscillator or a fixed-frequency oscillator and a frequency divider of variable frequency dividing factor for dividing the frequency of the output of said oscillator to form a tempo clock, and generates a tempo clock of a frequency which has 1/24 period of one beat length (4-th note). The frequency of the tempo clock can be varied by a tempo setting manipulator (such as volume or switch) not shown which is disposed on the panel surface.

The tone generator 18 has four (4) tone-producing channels for forming accompaniment tones, and has three (3) tone producing channels for forming melodies, and also has one tone-producing channels for forming bass tones, and forms tone (melody tone, accompaniment tone and bass tone) signals correspondingly to the tone informations supplied from the CPU 11. These tone signals are converted by a sound system not shown to audible sounds and pronounced therefrom.

OPERATION OF ELECTRONIC MUSICAL INSTRUMENT OF FIG. 1

Next, description will be made of the operation of the instant electronic musical instrument by referring to the flow charts of FIGS. 5 to 11.

1. Main routine processing

Figure 5:
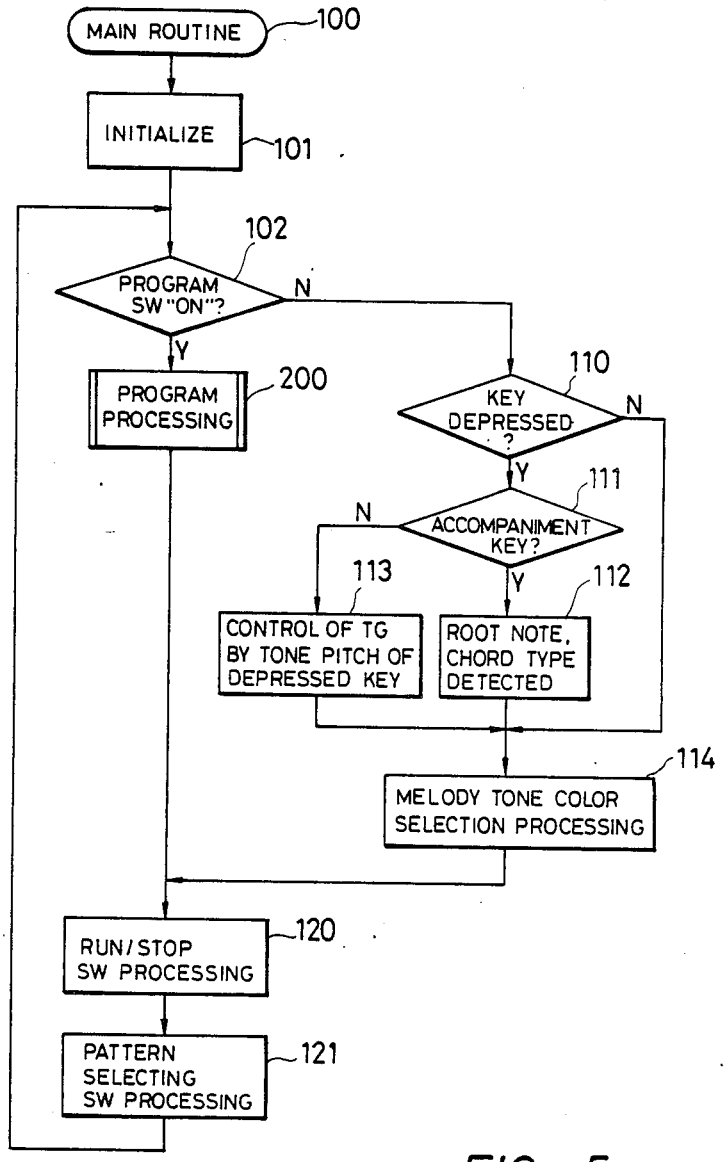
FIGS. 5 to 11 are flow charts for explaining the operations of the instrument of FIG. 1.

Referring now to FIG. 5, upon connecting this electronic musical instrument to a power supply not shown, the CPU 11 commences its operations in accordance with the control program stored in the program memory 13 (Step 100). In Step 101, the CPU 11 initializes the whole circuitry, such as clearing the clock counter QNT, the timing counter CLK, the root note name register ROOT, the run flag RUN and the program key code registers $KC_1$~$KC_3$, and rendering the old timing value register OLDCLK to "−1" and setting the timers $TIME_1$~$TIME_3$ to "255", respectively, and so on, and thereafter the CPU 11 carries out the main routine processing operations which are comprised of Steps 102~121 and Step 200.

In Step 102, the program switch 5 in the switch group 16 is checked to judge the operating mode in this electronic musical instrument. And, if the switch 5 is in its "turned-on" state, this means the programming mode, so that the program processing in Step 200 which will be described later is carried out. On the other hand, if the switch 5 is in its state of being turned off, this will be handled as the automatic accompaniment mode, so that the automatic accompaniment processing in Steps 110~114 which will be described later is carried out, and thereafter the processing will move onto Step 120. In this Step 120, the run/stop switch 3 is checked, and for each depression of this run/stop switch 3, the run flag RUN is subjected to a toggle-change from either "0" to "1" or from "1" to "0". In the succeeding Step 121, a pattern selecting switch processing such as scanning the pattern selecting switch 2 to detect either a selected pattern ("1"~"12") or the pattern register (=pattern "13") and setting the read-out pointer $(m)_i$ at the top-leading address of each channel "i" for a selected pattern ("1"~"13"), and thereafter the processing returns to Step 102.

2. Programming processing

Figure 6:
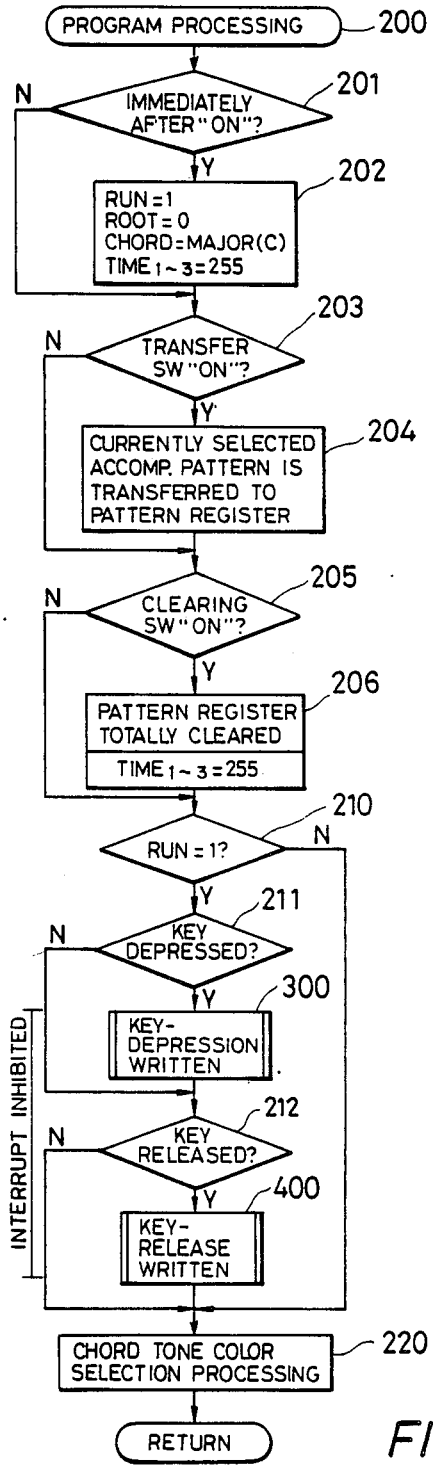

FIG. 6 shows the programming processing subroutine operation in Step 200 of FIG. 5. Referring now to FIG. 6, in Step 201, judgment is made whether the present time is immediately after the turn-on of the program switch 5. If now is immediately after its being turned-on, the run flag RUN is rendered to "1" in Step 202 to coercively turn-on the run/stop switch 3, and along therewith the root note name register ROOT is cleared, and the chord type register CHORD is set to C-major, and furthermore the respective timers $TIME_1$~$TIME_3$ are set to "255" (empty channel), respectively. It should be noted here that, unless the present time is immediately after the switch 5 has been turned on, the processing in Step 202 is not carried out, and processing advances directly to Step 203 from Step 201.

In Step 203 and Step 204, judgment is made whether the transfer switch 8 is turned on. In case the switch has been turned on, i.e. in case of programming a new accompaniment pattern while editting either one of the factory-made patterns ("1"~"12"), the currently selected accompaniment pattern is transferred to the pattern register.

Also, in Step 205 and Step 206, judgment is made whether the clearing switch 7 is turned on. If it is judged to be "turned-on", i.e. in case a completely new pattern is being formed, the pattern register is altogether cleared (i.e. all rendered to the rest notation), and in addition the respective timers $TIME_1$~$TIME_3$ are set to "255" (empty channel), respectively.

In Step 210, the run flag RUN is checked. In case the run flag RUN is reset, this means that the formation of an accompaniment pattern has completed and that the run/stop switch 3 has been rendered to its "stop" state.

Therefore, processing is immediately switched from the programming processing routine operation to return to the main routine processing (Step 120 of FIG. 5). On the other hand, in case the run flag RUN is found to be set, processing moves onto Step 211. In Step 211 and Step 212, judgment whether there is a key depression or a key release is made, respectively, and when a key depression event occurs, a key-depression writing processing is carried out in Step 300, and when a key-release event takes place, a key-release writing processing (Step 400) is carried out. In case no key-depression event or key-release event has taken place, and in case either the key-depression or key-depression writing processing in accordance with the occurred key-depression or key-release event has completed, processing advances onto Step 220 to carry out a chord tone color selecting processing. In this electronic musical instrument, the tone color selecting switches 4 for melody tones concurrently serve as the chord tone color selecting switches. In Step 220, a chord information in accordance with the state of selection done by the tone color selecting switch 4 is delivered out to the tone generator 18. It should be noted here that interrupt is inhibited during the period in which the abovesaid key-depression writing processing (Step 300) and the key-release writing processing (Step 400) are being carried out.

3. Key depression writing processing

Figure 7:
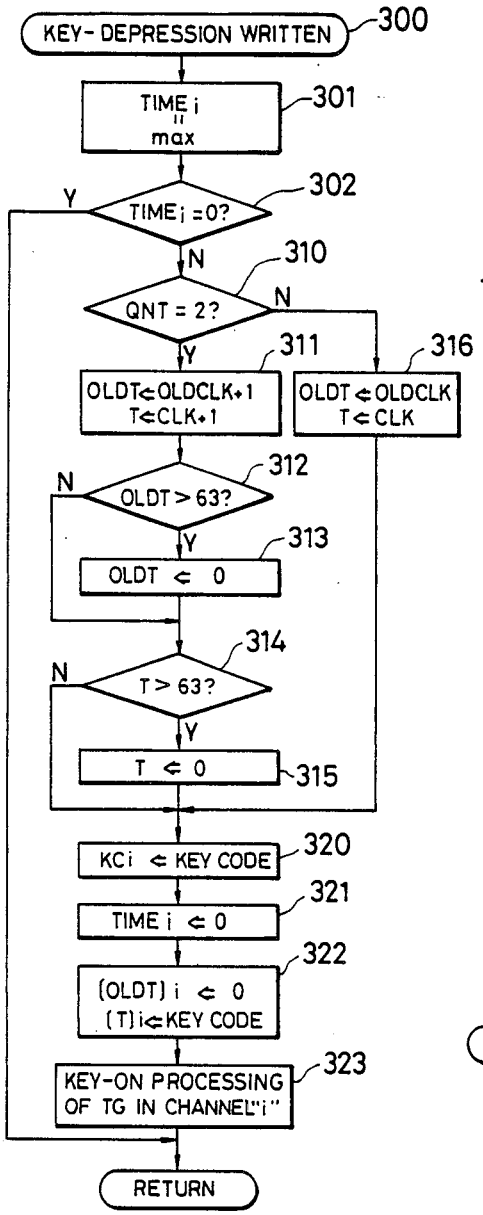

FIG. 7 shows the details of the key-depression writing processing (Step 300) of FIG. 6. This electronic musical instrument is constructed so that a maximum of three tones as accompaniment tones can be produced simultaneously. For this purpose, there are provided three channels for both tone producing and storing operations. Accordingly, if there takes place a fourth key-depression ("key-on" operation), there is the need to empty either one of the channels to assign, to the resulting emptied channel, the key datum accruing from this fourth key depression. Arrangement is provided in this embodiment that this key datum assignment (key assigning) is effected to an empty channel if there is any, and to the oldest key-released channel in case there is note empty channel, and to the oldest key-depressed channel in case there is no empty channel or no key-released channel. Such a channel is found by searching the specific timer $TIME_i$ whose contents present a maximum count value.

Referring now to FIG. 7, in Step 301, scanning is performed to detect, from among the timers $TIME_1 \sim TIME_3$, the one $TIME_i$ which presents a greatest count value. In the succeeding Step 302, judgment is made whether the count value of $TIME_i$ is "0". If $TIME_i$="0", this means that the three channels are in the midst of key-on state due to actual key depressions. Since, in this case, the four key depressions have an equal priority relative to each other, the three channels are left as they stand now, and the fourth key depression is disregarded. That means the pattern is not written in. In short, if $TIME_i$="0", the key depression which takes place at this occasion is disregarded, and processing returns to the former routine operation (Step 212 of FIG. 6) without carrying out any processing operation. On the other hand, if the result of judgment in Step 302 is $TIME_i \neq$"0", the key depression datum at said occasion is assigned to the channel "i".

Figure 12:
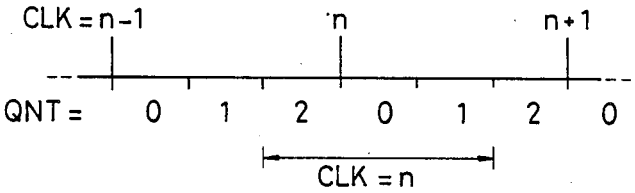
FIG. 12 is an explanatory illustration of the timing detecting operation conducted in the instrument of FIG. 1.

In this instant electronic musical instrument, as illustrated in FIG. 12, tempo clocks of the frequency which is of a 1/24 period of one beat are counted by the ternary clock counter QNT, and when this count value QNT changes from "2" to "0", the count value of the scale-of-64 timing counter CLK which counts n="0"~"63" is stepped up by "one". Also, arrangement is made so that the information of key depression which takes place during the interval between the respective count values from (CLK="n−1", QNT="2") till (CLK="n", QNT="1") is written in the pattern register as one having occurred at the timing CLK="n".

More particularly, by referring to FIG. 7, it should be noted that in Step 310, the count value QNT of the clock counter is checked. If the count value QNT is "2", the count value of the timing counter CLK and that of the old time value counter OLDCLK are advanced by "one", and along therewith their respective count values are stored in the provisional buffers T and OLDT, respectively. And, in the next Steps 312 and 313, if the count value OLDT exceeds "63", the provisional buffer OLDT is cleared. In Steps 314 and 315, processing is made with respect to the provisional buffer T in a manner similar to that for the provisional buffer OLDT. On the other hand, if QNT≠"2" in Step 310, the count value of the timing counter CLK and that of the old time count value counter OLDCLK are stored in the provisional buffers T and OLDT, respectively, in Step 316 without advancing their values, and then processing moves onto Step 320.

In Step 320, the key code due to the current key depression is stored in the key code buffer $KC_i$ at the time of programming so as to use the key code in scanning the channels at the time of key release. Successively thereto, "0" which indicates that a key is being depressed in the channel "i" is set in the timer $TIME_i$ in Step 321, and thereafter the provisional buffers OLDT and T are used to serve as the pointers "OLDT" and "T", respectively, in Step 322 to write a rest notation datum "0" and the abovesaid key code in the addresses designated by these pointers, respectively, in the pattern register. Whereby, in the current timing position "T" of the pattern register, there has been written "key depression start" information such that the old event is switched to bear the rest notation and the current event to bear a key code. Furthermore, in Step 323, there is performed a key-on processing in the channel "i" according to the key code $KC_i$, i.e. tone-production-start processing in accordance with current key code, and with this the processing returns to the former routine operation (Step 212 of FIG. 6).

4. Key-release writing processing

Figure 8:
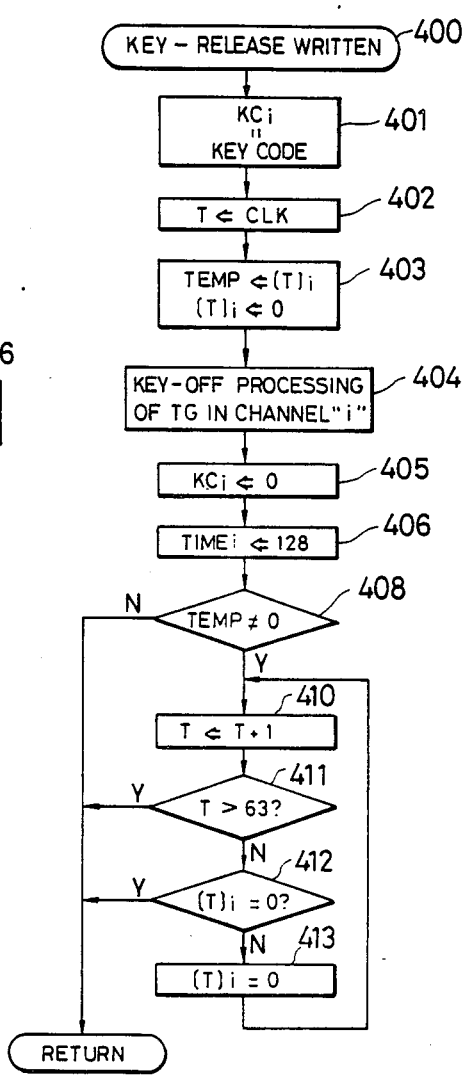

FIG. 8 shows the key-release writing processing (Step 400) routine of FIG. 6.

Referring now to FIG. 8, it should be noted that in Step 401, search is made of the specific $KC_i$, among those key code buffers $KC_1 \sim KC_3$ at the time of programming, which stores a key code same as the key code of that key which has been released just now. Next, in Step 402, the contents of the timing counter CLK are stored in the provisional buffer T, and in Step 403 the old information which has been stored in the address "T"$_i$ is stored in the provisional buffer TEMP, and along therewith a new information (rest notation) indicative of "completion of key depression" is stored in this address "T"$_i$. Successively thereto, a key-off processing (tone-production ceasing processing by dint of the current key-release key code) of the tone generator 18 in the channel "i" is carried out in Step 404, and the key code buffer $KC_i$ is cleared in Step 405 to render same to the key-off state, and "128" which is the datum indicating a key-release in the channel "i" is set in the timer $TIME_i$ in Step 406, and thereafter processing moves onto Step 408.

In Step 408, judgment is made whether the old information TEMP is "0" (rest notation). If the old information TEMP indicates the rest notation, processing returns therefrom directly to the former routine (Step 220 in FIG. 6). On the other hand, if the old information TEMP indicates something other than the rest notation (≠"0"), it should be noted that, if this state continues as it is, there will be produced at that portion of the pattern which has been rewritten into a new information, i.e. the overwritten portion, when an accompaniment is performed, an accompaniment tone under the old information, and thus the accompaniment itself will become unnatural. Therefore, in Steps 410~413, as shown in FIG. 13, the interval from the key-release under the new information B till the time the key-release information under the old information A is found is thoroughly cleared to bear the rest notation.

That is, referring to FIG. 8, the timing T is advanced by "one" in Step 410, and judgment is made in Step 411 whether the timing T has exceeded "63". If this count value has exceeded the pattern data writing range ("0"~"63"), processing will directly return to the former routine (Step 220 of FIG. 6). If the value is "63" or less, judgment is made in the next Step 413 whether the old information which has been registered in the address "T"$_i$ indicates the rest notation. If it indicates the rest notation, the processing will directly return to the old routine (Step 220 of FIG. 6). This is because of the following consideration. That is, even if the information is an old one, if this information has been written in before the beginning of at least one rest notation and again at the end thereof after key-release under the new information, i.e. a tone (C note in FIG. 13) having a prominent build-up, such an information or tone is to be retained as it is by giving an importance to this prominent build-up. On the other hand, in case the datum of the address "T"$_i$ is not the rest notation, the rest notation datum is written therein, and then processing returns to Step 410.

5. Automatic accompaniment processing

Referring to FIG. 5, in Step 110, output of the keyboard circuit 10 is received to judge whether a new key-depression has taken place. If there is found a new key-depression, this new key-depression is judged in Step 111 as to whether it has been done with accompaniment keys. If the result of this judgment indicates that the key-depression has been effected by accompaniment keys, their chord (root note and chord type) is detected in Step 122. On the other hand, if the key-depression is not effected by accompaniment keys, the tone generator 18 is controlled in Step 113 by virtue of the tone pitches of the depressed keys to produce tones exactly as per the depressed keys. Also, if the result of judgment in Step 110 indicates "no new key-depression", processing advances to Step 114 without passing through the processing in Steps 111 to 113. In Step 114, the tone color selecting switches 4 of the switch group 16 are scanned to detect its switch information, and after delivering out the detected tone color information to the tone generator 18, processing moves to Step 120.

6. Interrupt processing

As stated above, in the electronic musical instrument of FIG. 1, the tempo clock which is generated from the tempo generator 17 at a timing which is of a 1/24 period of one beat length (4-th note) is used as an interrupt signal, to carry out the below-mentioned interrupt processing (Step 500).

Figure 9:
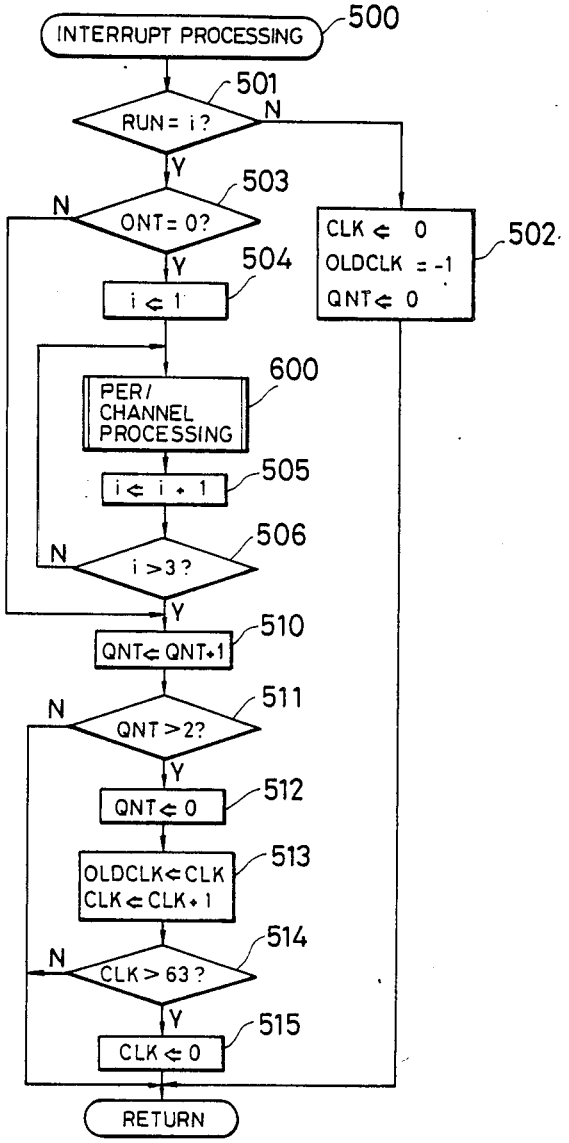

In FIG. 9, the run flag RUN is checked in Step 501. If this flag RUN indicates "0", this means that an accompaniment pattern is not being formed nor is an automatic accompaniment being played, so that in this Step 501, the timing counter CLK and the clock counter QNT are cleared, and the old timing value counter OLDCLK is set to "−1", and thereafter the interrupt is released, and processing returns to the former routine operation.

On the other hand, if the result of judgment in Step 501 indicates that the run flag RUN="1", this means that either an accompaniment pattern is being programmed or an automatic accompaniment is being played. In this case, the contents of the clock counter QNT are checked in Step 503. And, if, in Step 504, the contents of the counter QNT indicate "0", the channel number "i" is set to "1", and the per-channel processing in Step 600 is carried out.

7. Per-channel processing

Figure 10:
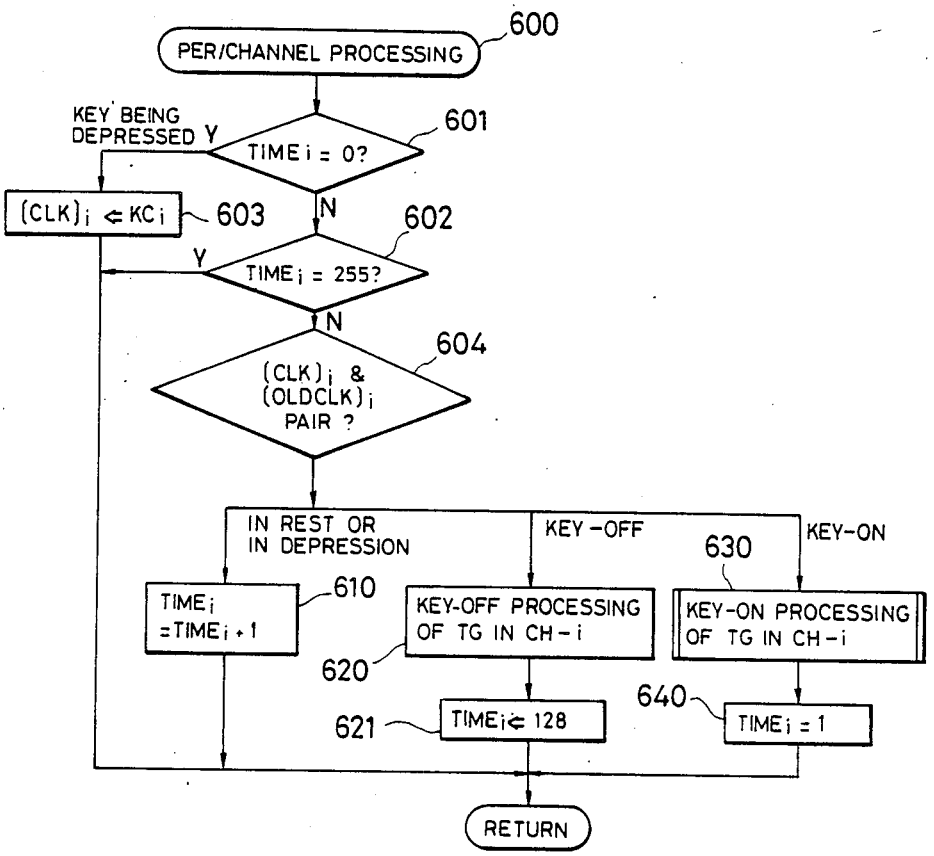

Referring now to FIG. 10, in Steps 601 and 602, the contents of the timer $TIME_i$ are checked. If the contents $TIME_i$ of the timer indicate "0", this signifies that this channel "i" is being occupied presently for key-depression under the programming mode. Therefore, processing moves from Step 601 over to Step 603, wherein the key code $KC_i$ due to the current key-depression is stored in the address "CLK" indicated by the timing counter CLK of the pattern register. This storing processing is carried out at each interrupt till the keys are released. Whereby, the abovesaid key code $KC_i$ will be stored in those respective addresses of the pattern register which correspond to the respective timings during the interval from the key-depression till the key-release.

Also, if the contents $TIME_i$ of the timer indicate "255", this means that the channel "i" is an empty channel. Therefore, processing passes through Step 602, and returns to the former processing routine (Step 505 of FIG. 9.)

Furthermore, in case the contents $TIME_i$ of the timer do not indicate "0", nor "255", check is made of a pair of the current event datum "CLK"$_i$ and the old event datum "OLDCLK"$_i$ with respect to the pattern (in which has been written the reading-out pointer in Step 121 of FIG. 5) selected by either the pattern selecting switch 2 or the user's-pattern switch 6 in Step 604, and processing corresponding to the meaning indicated by this pair is carried out. This pair and its meaning are as shown in Table 1 give below.

TABLE 1

| "OLD CLK" | "CLK" | Meaning (Processing) |
|---|---|---|
| 0 | 0 | under Rest |
| 0 | ≠0 | Key-on event |
| ≠0 | 0 | Key-off event |
| ≠0 | ≠0 | under Key-on |

wherein:
"0" represents rest notation; and
"≠0" represents any key code.

In case the above-mentioned pair of event data signifies either "under rest" or "under key-on", processing moves to Step 610, wherein the contents of the timer $TIME_i$ are advanced by "one" and thereafter the processing returns to the old processing routine (Step 505 of FIG. 9).

Also, in case the result of this checking indicates "key-off", processing moves onto Step 620, wherein a "key-off" processing of the tone generator in the channel "i" is carried out, and after the contents of the timer $TIME_i$ are set to "128" in Step 621, processing returns to the former processing routine (Step 505 of FIG. 9).

Also, if the result indicates "key-on", processing moves to Step 630, wherein the "key-on" processing of the tone generator in the channel "i" is carried out, and after the contents of the timer $TIME_i$ have been set to "1" in Step 640, processing returns to the former processing routine (Step 505 of FIG. 9).

8. Key-on processing

Figure 11:
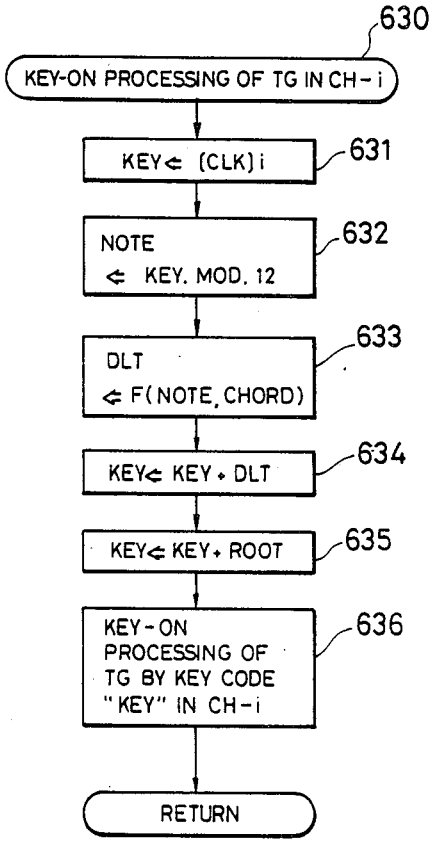

FIG. 11 shows the details of the above-mentioned "key-on" processing (Step 630). In Step 631 of FIG. 11, it should be noted that, in order to normalize the tone which requires to be produced, the current event datum "CLK"$_i$ is read out from the pattern memory 15 and it is stored in the register KEY which is intended for arpeggic chords. In Step 632, the note code NC of the key code KEY is calculated, and the result is stored in the provisional buffer NOTE. The key codes KC for the respective keys are assigned with numerical values which are integer-multiples of "12" for the C-named notes, respectively, and for each semi-tone higher note, a numerical value which is upped by one (1) is assigned. Also, note codes NC are assigned with values "0"~"11" obtained by designating "C" as "0" and each semi-tone as "1". Thus, a note code NC can be obtained as a residual from dividing a key code value by "12".

In the succeeding Step 633, reference is given to the Key Code Conversion Table (FIG. 14) which is formed locally either in the program memory 13 or in the pattern memory 15, and a tone pitch correction value for a note code NOTE and for a chord type CHORD (this latter is stored by Step 112 of FIG. 5) is read, and the result is stored in a provisional buffer DLT. In Step 634, the key code KEY contained in the register KEY is corrected by addition thereto of a tone pitch correction value DLT. In Step 635, the key code KEY contained in the register KEY is added further with a root note name datum ROOT to correct the tone pitch of this key code KEY. The above-said accompaniment pattern has been registered in C-major, and therefore in order to alter the chord type from major to any other chord type, its correction is made in Step 634. Also, in order to alter the root note of the chord to any other note, correction in Step 635 is carried out. In Step 636, the "key-on" processing is carried out with respect to the tone generator 18 by using the key code KEY which has been corrected to the actual tone pitch in such a way as described above with respect to the channel "i", and thereafter the processing returns to the former processing routine (Step 640 of FIG. 10). From Step 640 of FIG. 10, processing returns further to Step 505 of FIG. 9.

9. Interrupt processing (continued)

Referring to FIG. 9, in Step 505, the channel number "i" is subjected to advancement by one (1) stepwisely. In Step 506, judgment is made whether the advanced channel number "i" has exceeded "3". If the channel number "i" is "3" or smaller, this means that the channel processing (Step 600) has not been carried out with respect to the channel "i". Therefore, processing returns to Step 600 to carry out the channel processing. On the other hand, in case the advanced channel number "i" has exceeded "3", this means that the channel processing has completed for all channels "1"~"3", and thus processing moves onto Step 510.

In Step 510, the clock counter QNT is advanced stepwisely (renewed). In Step 511, judgment is made whether the count value of the counter QNT has exceeded "2". Since this counter QNT is a ternary counter for counting "0"~"2", it will be noted that if the count value is "2" or smaller, the interrupt processing which is going then is released, and processing returns to the former routine. On the other hand, if the count value has exceeded "2", this means that the counter QNT has completed the one counting cycle of "0"~"2". Accordingly, the counter QNT is cleared in Step 512, and along therewith the contents of the timing counter CLK are stored in the old timing value counter OLDCLK in Step 513, and thereafter the counter CLK is advanced (renewed). In Step 514, judgment is made whether the count value of the counter CLK has exceeded "63", and if it has not exceeded the value yet, processing remains to be running as it has been and if exceeded, the counter CLK is cleared in Step 515, and thereafter interrupt processing is released, and processing returns to the former routine.

Next, description will be made of a second embodiment wherein the present invention is applied to an electronic musical instrument provided with a custom rhythmic chord accompaniment function.

More particularly, this instant electronic musical instrument is one that the present invention is applied to the above-mentioned type instrument equipped with such a rhythmic chord function that the tones of a chord designated by key-depression effected on the keyboard are switched "on" and "off" rhythmically in accordance with the pattern data which are read out successively from the read-only memory. In this electronic musical instrument, the $C_2$ note key and the $D_2$ note key of the keyboard are used concurrently to serve as the "on"-"off" designating keys of chord tones. The $C_2$ note key is used for designating the tone-producing timing of normally produced chord tones, while the $D_2$ note key is used in imparting an accent to chord tones. In this instant embodiment, the working memory 14 is provided with such parts as various flags, registers and buffers as enumerated below.

QNT: Clock counter

It counts tempo clocks "0"~"2" (ternary count 0, 1, 2)

CLK: Timing counter

Its count value increments by "1" when count value of QNT returns from "2" to "0".

Its count values range "0"~"31" (wherein: "0"~"15" represent current timings occurring in odd-number measures, whereas "16"~"31" indicate current timings occurring in even-number measures)

OLDCLK: Old timing value register

Stores CLK value of one count prior (normal: CLK "−1", but when CLK="0", OLDCLK="31").

RUN: Run flag

It indicates whether rhythmic chord is playing which is indicated by "1", or ceased which is indicated by "0".

KC: Key code register for programming

During the programming mode, it takes a value of either "1" or "2" ($C_2$: "1", $D_2$: "2") for actual key depression (only $C_2$ and $D_2$ note keys). "1" corresponds to normal "key-on", and "2" corresponds to "key-on" with accent.

T: Provisional buffer of CLK
OLDT: Root note name register
It assumes a value of "0"~"11" in correspondence to notes C, C#~B.
CHORD: Chord type register
It assumes a value of "0"~"7" relative to types C, $C_{M7}$, $C_m$, $C_7$, $C_{7sus4}$, $C_{m7}$, $C_{m7}{}^{-5}$, respectively.
DLT, NOTE: Provisional buffers
KEY: Key code register for rhythmic chords
(m): Pointer for reading out data
Intended to read out data stored in the pattern memory 15. m=T, OLDT, CLK, OLDCLK. Pointer (m) points to the contents of address "m" for the pattern No. which is designated by the pattern selecting switch (including user's-pattern switch 6).

In the following description, it would be understood that the respective registers and their contents will both be indicated equally by the same label names. For example, the key code register for rhythmic chord and its contents will both be indicated by KEY.

A pattern memory 15 is comprised, as shown in FIG. 15 of a read-only memory ROM area storing factory-made accompaniment patterns (pattern Nos. 1~12) and a re-writable RAM area (pattern register) storing user's-pattern (pattern No. 13). In each pattern area is provided 2-bit and 33-byte length key code storing area for storing accompaniment date (off: "0" normal "on" ($C_2$ key): "1" and "on" with accent ($D_2$ key): "2"). These patterns are such that their addresses ("0"~"31") correspond to the count value of the timing counter CLK, respectively. That is, in these addresses are stored data at the timing of $\frac{1}{4}$ period of one beat length (4-th note), i.e. timing of 16-th note duration unit, in such a way that in address "1" is stored an accompaniment pattern datum at timing "1", . . . , and in address "31" is stored a datum at timing "31". Also, in address "−1" is always stored the datum "0".

A tempo setter (generator) 17 is constructed in a manner similar to that of the first embodiment excepting that it generates a tempo clock pulse of a frequency which is of 1/12 period of one beat length (4-th note), i.e. a frequency which is three times greater that of the timing counter CLK.

The tone generator 18 is constructed in the same way as the one used in the first embodiment.

OPERATION OF THE ELECTRONIC MUSICAL INSTRUMENT OF SECOND EMBODIMENT

Description will hereunder be made of the operation of the electronic musical instrument according to the second embodiment, by referring to the flow charts mentioned in FIG. 5 and FIGS. 16 to 20.

1. Main routine processing

The main routine processing in this instant embodiment is substantially the same as that of the first embodiment, and accordingly its detailed explanation is omitted.

2. Programming processing

Figure 16:
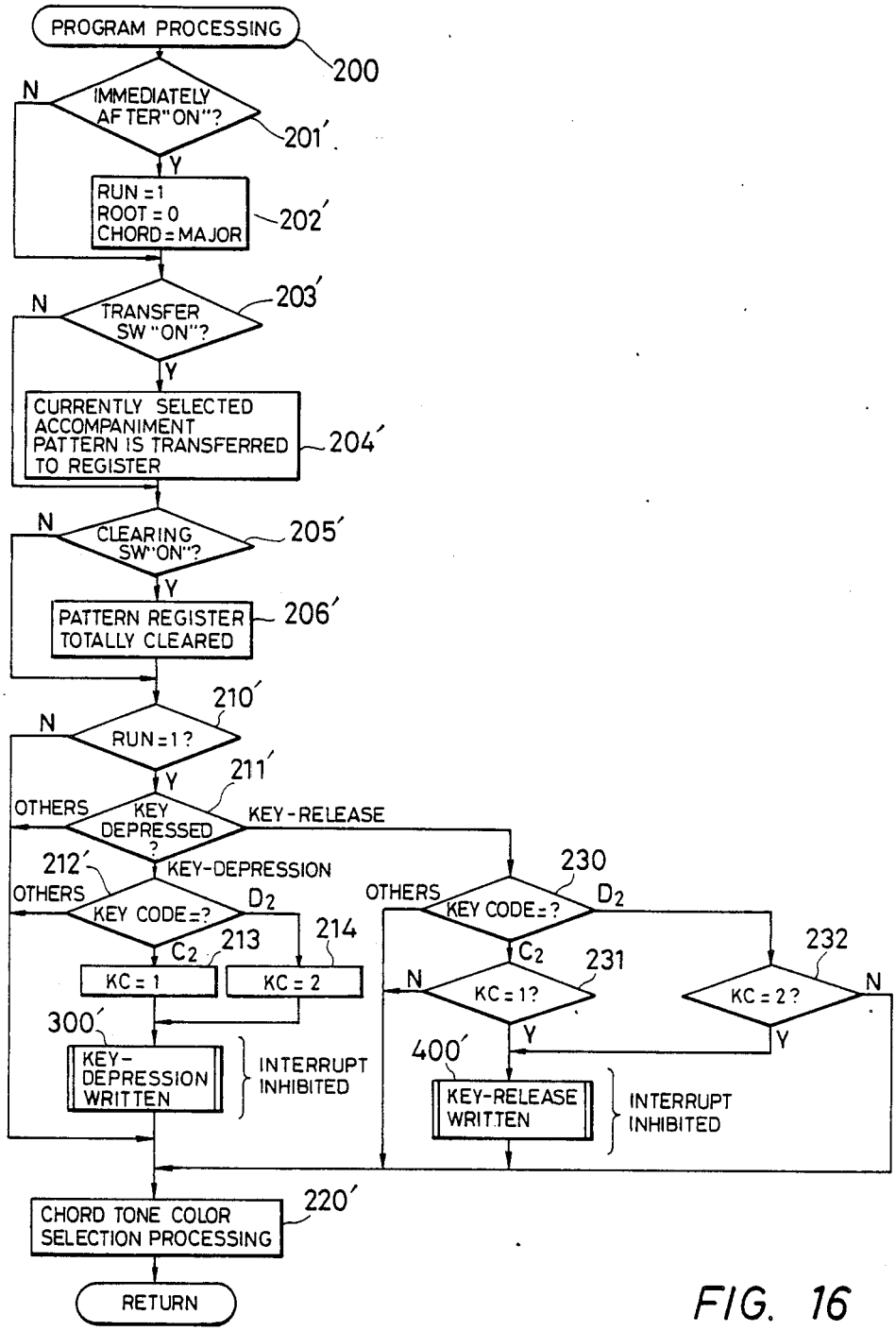
FIGS. 16 to 20 are flow charts for explaining the operations of the instrument having the pattern memory shown in FIG. 15.

FIG. 16 shows the programming processing subroutine in Step 200 of FIG. 5. Referring now to FIG. 16, in Step 201', judgment is made whether the current timing is immediately after the programming switch 5 is turned on. If it is immediately after that, the run flag RUN is rendered to "1" in Step 202' to coercively turn the run/stop switch 3 on, and along therewith the root note name register ROOT is cleared and the chord type register CHORD is set to C-major. If the timing is not "immediately after that", the processing in Step 202' is not performed, and the processing advances directly onto Step 203' from Step 201'.

In Step 203' and Step 204', judgment is made whether the transfer switch 8 is turned on. If it is turned on, i.e. which means the case for programming a new accompaniment pattern by editting either one of the factory-made patterns "1"~"12", the accompaniment pattern which is being currently selected is transferred to the pattern register 13.

Also, in Step 205' and Step 206', judgment is made whether the clearing switch 7 is turned on. In case this switch is turned on, i.e. the case for programming a completely new accompaniment pattern, the pattern register 13 is totally cleared.

In Step 210', the run flag RUN is checked. In case the run flag RUN is found to be reset, this means the case in which the programming of the accompaniment pattern has been completed and the run/stop switch 3 has been rendered to its stopped state. Therefore, the processing switches immediately from the programming processing routine and returns to the main routine processing (Step 120 of FIG. 5). On the other hand, in case the run flag RUN is found to be set, processing moves to Step 211'.

In Step 211', judgment is made whether there has occurred a key-depression event or a key-release event based on a key code outputted from the keyboard circuit 10. And, if a key-depression event has taken place, the key codes of the keys of which said key-depression event has occurred are checked in Step 212'. In this instant embodiment, arrangement is made so that as the keys which can be used for programming, $C_2$ key is used for normal chord tones, and $D_2$ key for chord tones with accent. Therefore, if either the $C_2$ key or the $D_2$ key is being depressed in Step 212', a key code "1" ($C_2$) or "2" ($D_2$) is stored in the key code register in either Step 213' or Step 214' in accordance with the depressed keys. Successively thereto, key depression writing processing in Step 300' which will be described later is carried out, and processing moves onto Step 220'.

In case an occurrence of a key-release event is detected in Step 211', processing moves to Step 230'. In Step 230', if the released key is either the $C_2$ key or the $D_2$ key, processing moves to either Step 231' or 232' in accordance with the released key, and judgment is made whether there is a coincidence between the contents of the key code register and the key code ($C_2$: "1", $D_2$: "2") at the time of programming which is assigned to either the $C_2$ key or the $D_2$ key. If there is a coincidence, the key-release writing processing which will be described later in Step 400' is carried out, and then processing moves to Step 220'.

On the other hand, in case the run flag RUN is not set (Set 210'), or in case of no key-depression event or no key-release event (Step 211') such that the key depression is one which has been continued since before the checking is made, or in case of an event which is other than $C_2$ and $D_2$ keys (Step 212', 230'), or in case the released key is not stored in the key code register (Step 231', 232'), processing moves directly to Step 220' without passing through the processing in Steps 213', 214' and 300' or Steps 230' 232' and 400'.

In Step 200', chord tone color selecting processing is carried out. In this instant electronic musical instrument, the chord tone color selecting switches concurrently serve as the tone selecting switches 4 for melody tones. In Step 220', a chord tone information in accordance with the state of selection of the tone color selecting switch 4 is delivered out to the tone generator 18. It should be noted here that during the period in which the abovesaid key-depression writing processing (Step 300') and the key-release writing processing (Step 400') are being carried out, such interrupt processing as the timer interrupt which will be described later is inhibited.

3. Key-depression writing processing

Figure 17:
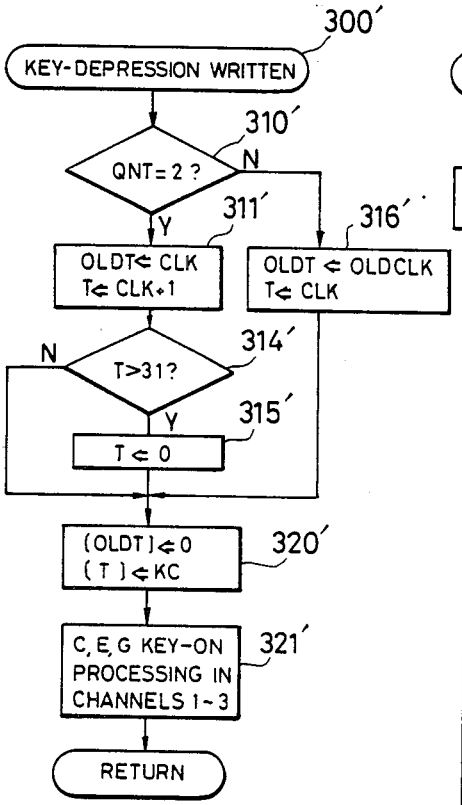

FIG. 17 shows the details of the key-depression writing processing (Step 300') of FIG. 16.

In the electronic musical instrument according to the second embodiment, tempo clocks of 1/12 period of one beat length are counted by the ternary clock counter QNT, and as shown in FIG. 12, when this count value QNT changes from "2" to "0", the scale-of-32 timing counter CLK which counts "0"~"31" is advanced by "1". Also, arrangement is made so that key depressions occurring in the interval where the respective count values range: (CLK=n−1, QNT=2) to (CLK=n, QNT=1) are written by regarding them to have occurred at timing CLK=n.

More particularly, referring now to FIG. 17, in Step 310', the count value of the clock counter QNT is checked. If the count value QNT is "2", both the timing counter CLK and the old timing value counter OLDCLK are advanced by "one" in Step 311', and their count values are stored in the provisional buffers T and OLDT, respectively. And, in the succeeding Steps 314' and 315', if the count value T exceeds "31", this provisional buffer T is cleared, and thereafter if not exceeding, processing moves directly to Step 320'. On the other hand, if in Step 310', QNT ≠"2", the count values of the timing counter CLK and that of the old timing value counter OLDCLK are stored, respectively, in the provisional buffers T and OLDT without advancing these values in Step 316', and thereafter processing moves onto Step 320'.

In Step 320', the provisional buffers OLDT and T are used to serve as pointers "OLDT" and "T", and the rest notation datum "0" and the key codes KC stored in the key code register in Step 213' and Step 214' are written in the addresses, respectively, in the pattern register designated by the respective pointers. Whereby, in the current timing position "T" of the pattern register, the "key-depression start" information such that the old event is "0" and that the current event provides for the key code KC has now been written. Furthermore, a key-on processing (tone-production start processing by the current key code of the tone generator 18 in channels "1"~"3" is carried out in Step 321'. Here, the respective channels are used for the production of tones in C, E and G. In short, the tones produced through the respective channels "1"~"3" are fixed to C, E and G during the programming mode, and the tones will be sounded out in C-major. After the completion of processing in Step 321', the processing returns to the former routine (Step 220' of FIG. 16).

4. Key-release writing processing

Figure 18:
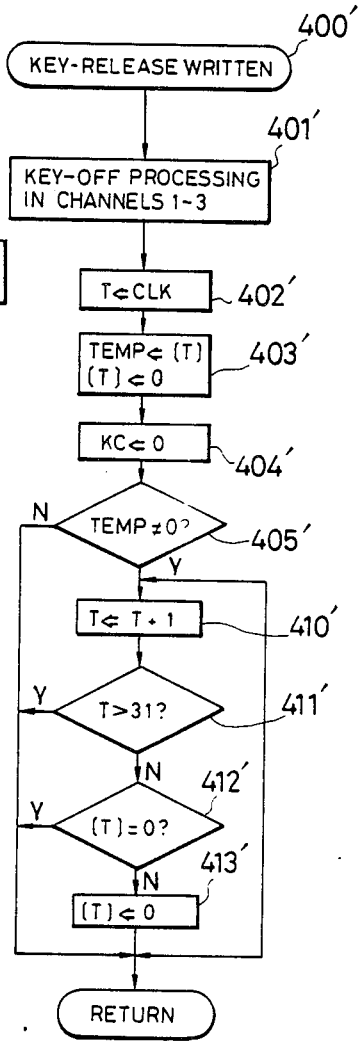

FIG. 18 shows the key-release writing processing (Step 400') of FIG. 16.

Referring now to FIG. 18, in Step 401', "key-on" processing (stop processing of tone production by current key-release key code) of the tone generator 18 in the channels "1~3" is carried out, and in Step 402', the contents of the timing counter CLK are stored in the provisional buffer T. In Step 403', the old information stored in the address "T" of the pattern register is stored in the provisional buffer TEMP, and along therewith in this address is stored a new information (rest notation) indicative of the "completion of key depression=key release". Successively thereto, the key code buffer KC is cleared in Step 404' to render same to the rest notation state, and thereafter processing moves to Step 405'.

In Step 405', judgment is made whether the old information TEMP is "0" (rest notation). If the old information TEMP indicates rest notation, processing directly returns to the former routine (Step 220' of FIG. 16). On the other hand, if the old information TEMP is something other than rest notation (≠"0"), it will be noted that if this state continues as it is, an accompaniment tone due to the old information will be sounded out again in continuation immediately after the key release under the new information at the portion of the pattern which has been re-written into the new information (the over-written portion) at the time of performing an automatic accompaniment, and the sound becomes unnatural. Therefore, in Steps 410'~413', the interval from after the key release under the new information B till the key release information (rest notation) under the old information A can be found is totally erased to be rendered to the rest notation.

That is, by referring to FIG. 18, the timing data T is advanced by "one" in Step 410', and judgment is made whether the timing T has exceeded "31" in Step 411'. If the timing T has exceeded the pattern data writing range ("0"~"31"), processing directly returns to the former routine (Step 220' of FIG. 16). If the timing T indicates "31" or less, judgment is made whether the old information written in the address "T" is the rest notation, in the next Step 413'. If the indication is the rest notation, the processing directly returns to the former routine (Step 220' of FIG. 16). This is intended so that even if the information is an old one, when there is a "key-on" after at least one rest notation following a key release under the new information, i.e. in case of a prominent build-up of tone signal (refer to "C" in FIG. 13), this build-up is given importance and the tone-production information of "C" is retained as it is. On the other hand, unless the datum of the address "T" is a rest notation, a rest notation datum is written therein, and then processing returns to Step 410'.

5. Automatic accompaniment processing

Referring now to FIG. 5 again, in case the programming switch 5 is turned off in Step 102 as stated above, processing moves to Step 110. The processing carried out in Steps 110~114 is same as in the first embodiment, and accordingly its detailed explanation is omitted.

6. Interrupt processing

As stated above, in the electronic musical instrument of the second embodiment, the tempo clocks which are generated from the tempo generator 17 at the timing of 1/12 period of one beat length (4-th note) are used as interrupt signals for carrying out the below-mentioned interrupt processing (Step 500').

Figure 19:
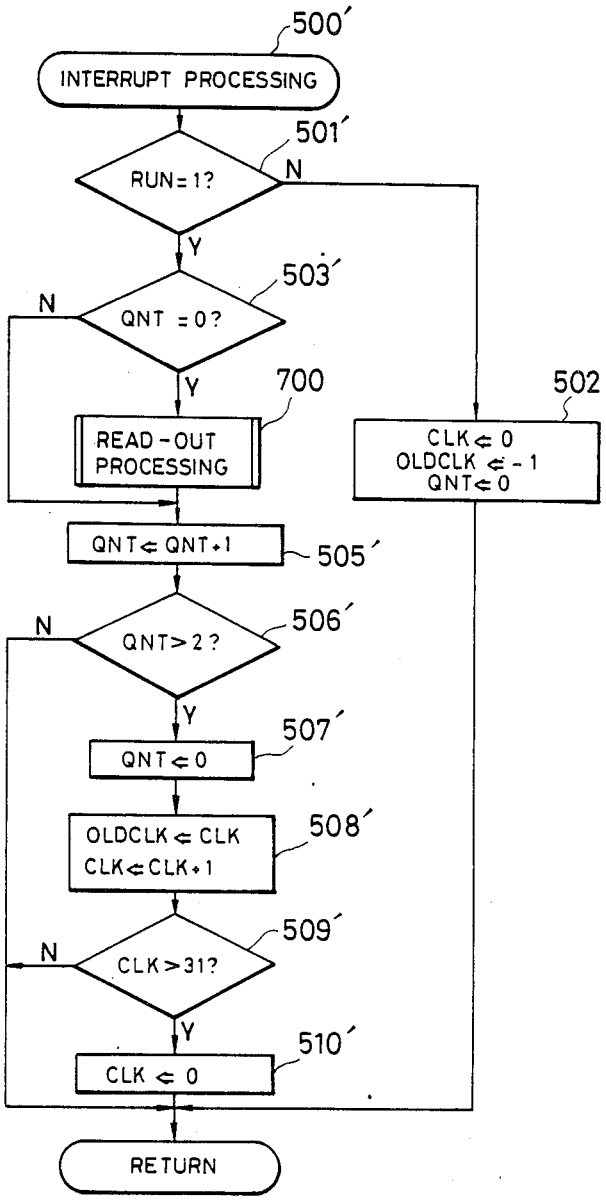

In FIGS. 19, in Step 501', the run flag RUN is checked. If the flag RUN is "0", this means that an accompaniment pattern is not being programmed or that an automatic accompaniment is not being played. Therefore, both the timing counter CLK and the clock counter QNT are cleared in Step 501', and after setting the old timing value counter OLDCLK to "−1", the interrupt is released and processing returns to the former routine operation.

On the other hand, in case the result of judgment in Step 501' indicates that the run flag RUN="1", this means either the accompaniment pattern is being programmed or the automatic accompaniment is being performed. In this case, the contents of the clock counter QNT are checked in Step 503'. And, if the contents of the counter QNT indicate "0", the reading-out processing in Step 700 is carried out.

7. Reading-out processing

Figure 20:
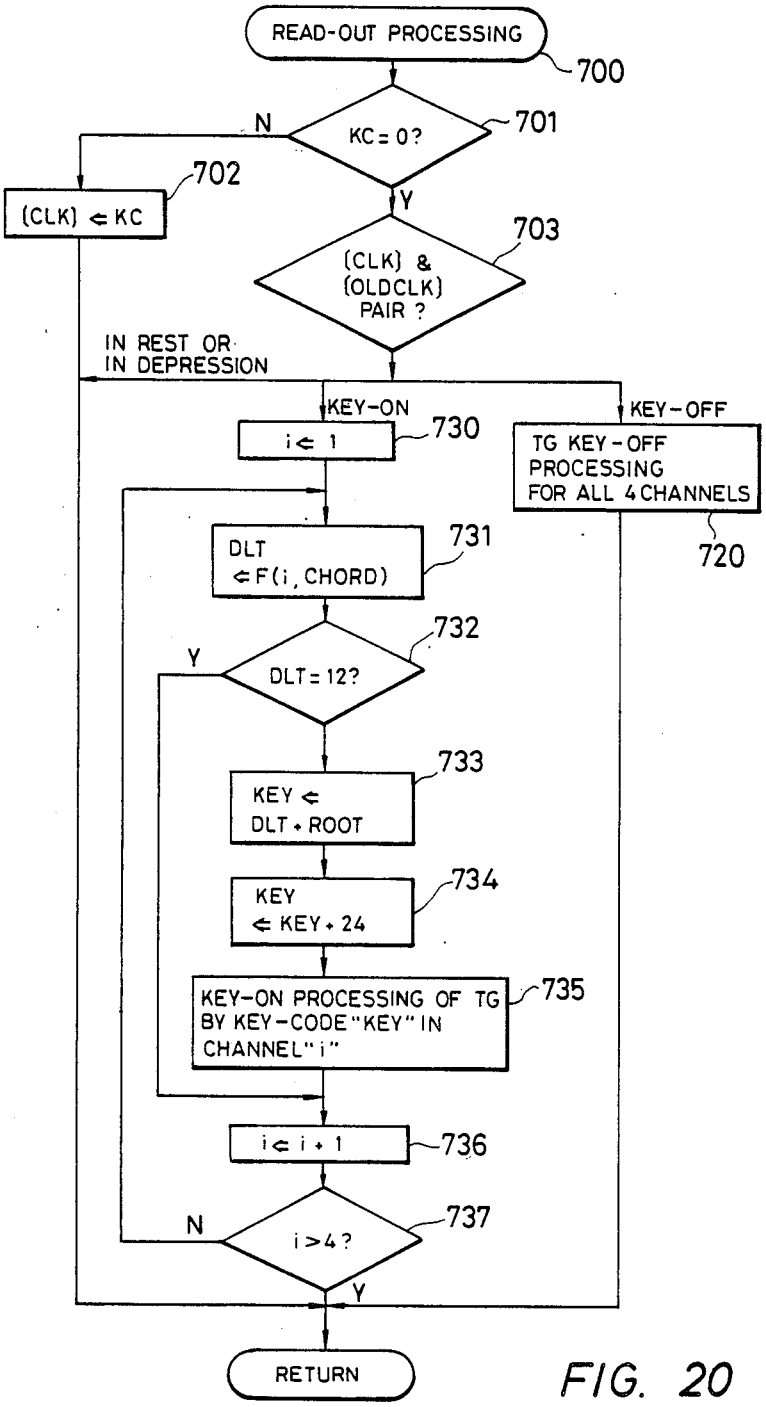

In FIG. 20, in Step 701, the contents of the key code register KC are checked. If the contents of this register indicate other than "0", it will be understood that, since at the present moment, actual key depression is being done under the programming mode, processing moves over to Step 702, wherein the key code KC due to the current key depression is stored in the address "CLK" (pattern register) indicated by the timing counter CLK, and thereafter processing returns to the former routine operation (Step 505' in FIG. 19). This storing processing is carried out for each interrupt until key released. Whereby, in the pattern register, there is stored the abovesaid key code KC in each address "CLK" thereof corresponding to each timing from a key depression to a key release.

On the other hand, if, in Step 701, the contents of the key code register KC indicates "0", processing advances to Step 703, wherein checking is made of the combination of the current event datum "CLK" and the old event datum OLDCLK" with respect to the pattern (in which the reading-out pointer has been set in Step 121 of FIG. 5) selected by either the pattern selecting switch 2 or the user's-pattern switch 6, and a processing complying with the significance indicated by this combination is carried out. This combination and its significance are as shown in Table 2 below.

TABLE 2

| "OLDCLK" | "CLK" | Significance (Processing) |
|---|---|---|
| 0 | 0 | under Rest |
| 0 | ≠ 0 | Key-on event |
| ≠ 0 | 0 | Key-off event |
| ≠ 0 | ≠ 0 | under Key-on |

wnerein:
0 represents rest;
≠ 0 represents (= 1 or 2)
1: normal "on"
2: "on" with accent In case the above-mentioned combination of event data means either a rest notation or a key-on running, processing directly returns to the former processing routine (Step 505' of FIG. 19).

Also, if the combination indicates "key-off", processing advances to Step 720, wherein, after the key-off processing of the tone generator 18 has been carried out for all of the four (4) channels processing returns to the former routine operation (Step 505' of FIG. 19).

Also, if the combination indicates "key-on", processing advances to Step 730. In Step 730, the channel number "i" is set to the initial value "1". In the succeeding Step 731, a tone pitch correction value for the channel number "i" and for the chord type CHORD (stored in Step 112 of FIG. 5) is read from the key-off set data table (FIG. 21) which is formed locally in either the program memory 13 or the pattern memory 15, and it is stored in the provisional buffer DLT. The tone pitch correction value "12" given in the key-off set data table means "no production of tone". The result of judgment in Step 732 is intended to carry out tone pitch correction only in case the tone pitch correction value DLT in the provisional buffer DLT is not "12". That is, in case the tone pitch correction value DLT is not "12", processing in Steps 733~735 is carried out and then processing moved to Step 736, while in case the tone pitch correction value DLT is "12", processing moves directly to Step 736.

In Step 736, the tone pitch correction value DLT is added to the root note name datum ROOT, and the note code for producing a tone through the channel "i" is sought, and the result is stored in the key code register KEY. In Step 734, by adding "24" to the note code contained in the register KEY, this note code is subjected to "two-octave shifting" and converts this note code to a tone pitch datum (key code) of $C_3 \sim B_3$ which represents the range of the tone compass of the accompaniment tones. In the succeeding Step 735, a key-on processing of the tone generator 18 is carried out with the key code KEY which has been corrected to actual tone pitch in such a way as mentioned above.

In Step 736, the channel number "i" is advanced by "one", and thereafter judgment is made whether this channel number "i" has exceeded "4" in Step 737. In this instant embodiment, there are provided four (4) channels for the formation of tones of accompaniment, and key-on processing of tones forming codes are carried out in the order beginning from channel No. 1. Therefore, when the result of judgment of the channel number "i" exceeds "4", this means that key-on processing has been completed for all of these four (4) channels. Accordingly, if the channel number "i" is "4" or smaller, processing returns to Step 731, and key-on processing in Steps 731~736 is carried out with respect to the channel of this detected number. On the other hand, if the channel number in Step 737 exceeds "4", processing returns to the former processing routine (Step 505' of FIG. 19).

8. Interrupt processing (continued)

Here again reference is made to FIG. 19. In Step 505', the clock counter QNT is advanced (renewed), and in Step 506', judgment is made whether the count value of the counter QNT has exceeded "2". If the count value indicates "2" or smaller, the interrupt is released without going through any other processing, and the processing returns to the former routine operation. Since the counter QNT is for counting ternary counter counting "0"~"2", if its count value QNT exceeds "2", this means that this counter has completed counting of one cycle of "0"~"2". In this case, the processing advances to Step 507' to clear the counter QNT, and along therewith the timing counter CLK is advanced (renewed) in Step 508'. Furthermore, in Step 509', judgment is made whether the count value of the ternary timing counter CLK which counts "0"~"31" has exceeded "31". If the value has not exceeded "31", interrupt is released and processing returns to the former routine operation. However, if the count exceeds "31", the counter CLK is cleared in Step 510', and then interrupt is released and processing returns to the former routine.

The present invention is not limited to the above-described two embodiments, but it may be modified appropriately and put to practice. For example, description of the above embodiments has been made with respect to the instance of programming a 4-beat (quadruple) accompaniment pattern and of performing an automatic accompaniment. It should be noted, however, that in cases of three (3) and two (2) beats, the timing counter CLK may be operated between count values of "0"~"47" and "0"~"31" or between "0"~"23" and "0"~"15", respectively, whereby it is apparent that programming and automatic accompaniment may be carried out in the same manner as for the instance of four (4) beats. Also, in the foregoing description, there is provided only one set of users'-pattern register (memory). This may be provided in a plural number. Also, the root notes have been set to "0"~"11" from C to B. However, the interval from G to B may be stepped downed by one octave to provide "−5"~"+6" from G to F# and thus tonality shifting based on the abovesaid root tones may be effected. Also, since the abovesaid electronic musical instrument is controlled of its operations by tempo clocks, it is possible to provide rhythm patterns, to produce rhythm tones in synchronism with the abovesaid automatic accompaniment. Furthermore, as the method of inputting chords, any method such as single finger mode and the like in addition to the fingered mode may be adopted.

What is claimed is:

1. An electronic musical instrument performing automatic accompaniment on programmable memorized pattern, comprising:

a tempo clock generator for generating a tempo clock signal defining time reference of music progression;

an accompaniment keyboard including playing keys to be manipulated by a player with rhythmic depressions;

key depression detecting means for detecting depressions of said keys and generating key timing data indicative of timings of the respective key depressions with reference to said tempo clock signal;

writable memory means for storing said key timing data constituting an accompaniment time pattern;

another memory means for storing normalized pitches of tone sequence constituting an accompaniment pitch pattern with relative pitches;

chord name designating means for designating names of accompaniment chords, each chord name being identified by a tonality and a type of a chord;

accompaniment tone data providing means for providing tone data representing tones to be produced for an accompaniment performance based on said normalized pitches read out from said another memory means and said chord names; and tone producing means responsive to said key timing data read out from said writable memory means and to said tone data for producing musical tones of pitches as designated by said tone data at timings as designated by said key timing data.

2. An electronic musical instrument according to claim 1, wherein:

said key depression detecting means further generates pitch data indicative of pitches of the respective depressed keys, and said another memory means is a further writable memory storing said pitch data in a form of memorized pitches.

3. An electronic musical instrument according to claim 1, wherein:

said tone data provided by said accompaniment tone data providing means are indicative of tones constituting the tonality and the type designated by said chord name designating means.

4. An electronic musical instrument according to claim 1, wherein:

said chord name designating means are some of the keys included in said accompaniment keyboard.

5. An electronic musical instrument according to claim 1, wherein said key depression detecting means is capable of detecting relative pitches of depressed keys to be stored in said another memory means.

* * * * *